US005944071A

United States Patent [19]

Tietz et al.

[11] Patent Number: 5,944,071

[45] Date of Patent: Aug. 31, 1999

[54] TWO CHAMBER FILLING TANK

[75] Inventors: Felix Tietz, Hamburg; Wolfgang Wilke, Hoisdorf, both of Germany

[73] Assignee: Crown Simplimatic Incorporated, Lynchburg, Va.

[21] Appl. No.: 09/030,325

[22] Filed: Feb. 25, 1998

[51] Int. Cl.[6] ..... B65B 43/42

[52] U.S. Cl. ..... 141/145; 141/129; 141/144; 222/167; 222/168; 222/168.5

[58] Field of Search ..... 141/129, 135, 141/144, 145, 89; 222/108, 129.1, 167, 168, 168.5

[56] References Cited

U.S. PATENT DOCUMENTS

| | | | |
|---|---|---|---|
| 314,165 | 3/1885 | Butler . | |
| 2,152,956 | 4/1939 | Etzkorn . | |
| 2,413,194 | 8/1946 | Russell | 141/59 |
| 3,653,395 | 4/1972 | Chapman . | |
| 5,240,038 | 8/1993 | Canedi . | |

*Primary Examiner*—Steven O. Douglas
*Assistant Examiner*—Timothy L. Maust
*Attorney, Agent, or Firm*—Howard & Howard

[57] ABSTRACT

A beverage filling machine (10) for conserving beverage at the end of a production run of the type comprising at least one filling assembly (20) for filling a beverage container (22) and a supply tank (12) for supplying beverage (32) to the filling assembly (20). The machine (10) is characterized by the supply tank (12) including a an endless wall (42) movable between an open position disposed above a ledge (38) disposed vertically above said bottom (28) for allowing beverage (32) to level completely across the tank (12) and a closed position in sealing engagement with the ledge for dividing said tank (12) into an isolated volume (34) and a useable volume (36) for removing beverage (32) from said isolated volume (34) and allowing beverage (32) to level only in said useable volume (36). An actuator (46) moves the endless wall (42) vertically between the open and closed positions. A main supply line (60) establishes beverage flow with the bottom (28) of said tank (12) below the ledge (38) and a secondary supply line (62) establishes beverage flow above said ledge (38) and outside of the endless wall (42). Valves (68, 70 and 74) control the flow of beverage to and from the tank (12) and the useable volume (36), abetted by a pump (76).

19 Claims, 4 Drawing Sheets

TWO CHAMBER FILLING TANK

BACKGROUND OF THE INVENTION

1. Field of the Invention

The subject invention relates to a machine for filling beverage containers, e.g., a bottling machine.

2. Description of the Prior Art

Beverage filling machines of the type having a central tank surrounded by container filling apparatus are well known in the art. The beverage is supplied to the central tank from a beverage processor and is fed radially outwardly to the filling assemblies. A problem with such assemblies is the volume of beverage which is lost at the end of a run of filling, as in changing over from one beverage to another. This occurs because of the volume of beverage which is held in the central tank because it will not flow through the radial feed lines to the filling assemblies, usually because the feeder lines are above the bottom of the central tank.

SUMMARY OF THE INVENTION AND ADVANTAGES

The subject invention provides a beverage filling machine for conserving beverage at the end of a production run. The machine comprises at least one filling assembly for filling a beverage container and a supply tank for supplying beverage to the filling assembly. The machine is characterized by the supply tank including a tank divider movable between an open position allowing beverage to level completely across the tank and a closed position for dividing the tank into an isolated volume and a useable volume for removing beverage from the isolated volume and allowing beverage to level only in the useable volume.

The invention also presents a method of conserving beverage at the end of a run of filling beverage containers from a supply tank having a vertical wall and a bottom and which comprises the steps of filling the tank with beverage to level beverage completely across the tank as confined by the vertical wall thereof and filling containers with beverage flowing horizontally from the vertical wall of the tank. The method is characterized by dividing the tank into a useable volume adjacent the vertical wall and an isolated volume over the bottom of the tank and removing beverage from the isolated volume and into the useable volume allowing beverage to level only in said useable volume for filling the containers.

Accordingly, the subject invention minimizes the amount of beverage which is lost at the end of a production filling run by effectively emptying the bottom of the supply tank. This is accomplished by isolating and emptying the bottom of the tank and conveying the beverage so emptied to a useful volume nest adjacent the radial feed lines.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
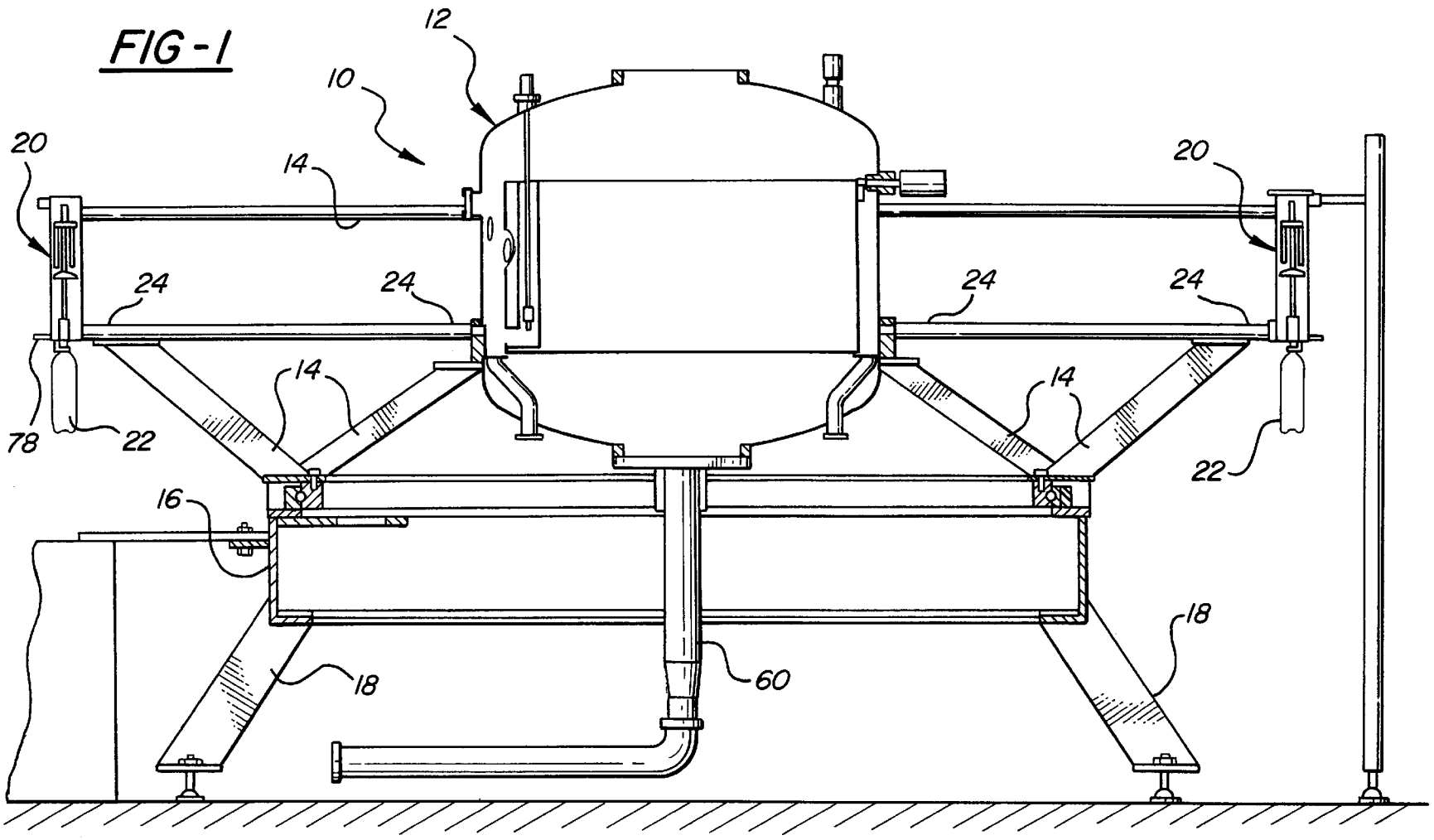
FIG. 1 is a side elevational view partially in cross section of a preferred embodiment.
Figure 1A:
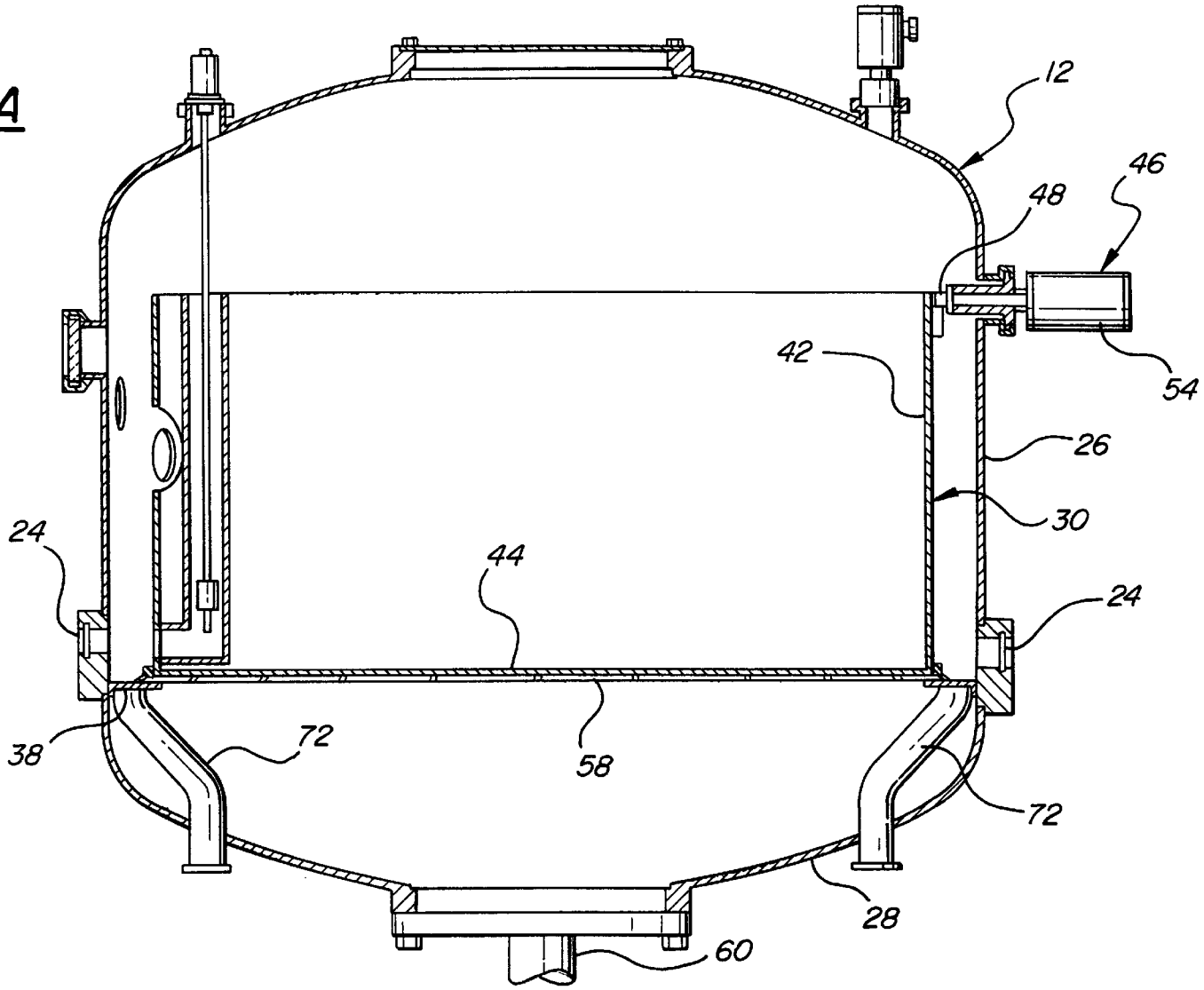
FIG. 1A is an enlarged side elevational view partially in cross section of the preferred embodiment of FIG. I but showing only the tank.
Figure 3:
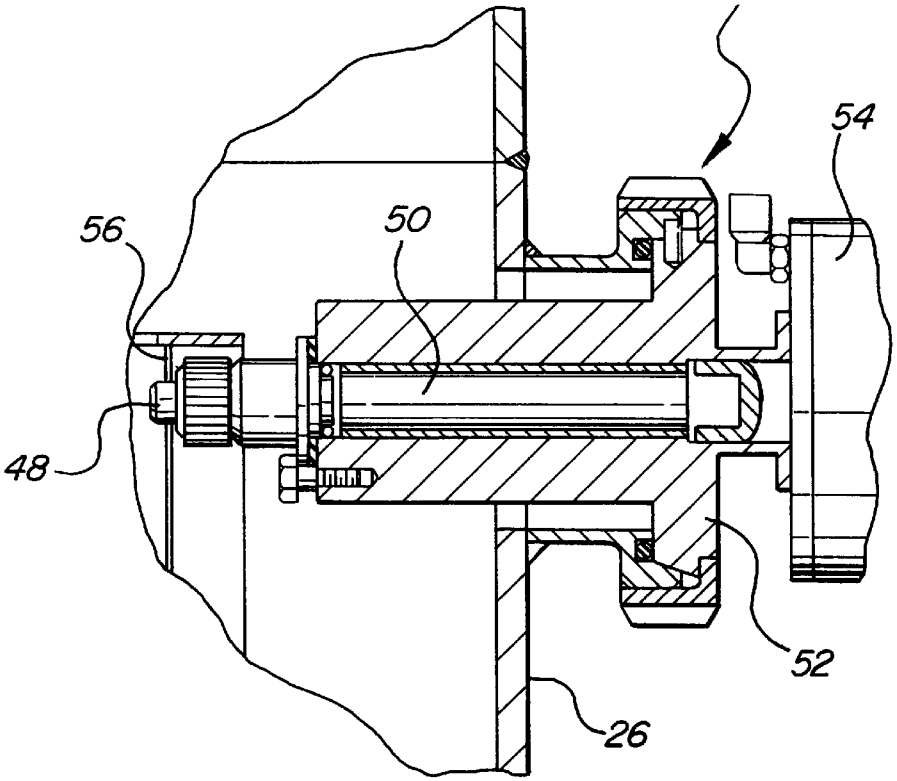
FIG. 3 is an enlarged fragmentary view of the actuator of the preferred embodiment.

Referring to the Figures, wherein like numerals indicate like or corresponding parts throughout the several views, a beverage filling machine is generally shown at 10. The filling machine 10 is of the type well known in the art with a centrally located supply tank, generally indicated at 12, supported on a framework 14, which is, in turn, supported on a base 16, the base being supported on legs 18. As is well known in the art, the machine 10 is circular and a conveyor moves containers, e.g., bottles or cans, around the machine 10 to be filled with beverage at the filling assemblies, each of which is generally indicated at 20. The machine 10, therefore, at least one filling assembly 20 for filling a beverage container 22. The supply tank 12 supplies beverage to the filling assembly 20 through feed lines 24 which extend radially and horizontally from the supply tank 12 to the filling assemblies. The tank 12 includes a peripheral vertical wall 26 and a bottom 28.

Figure 2:
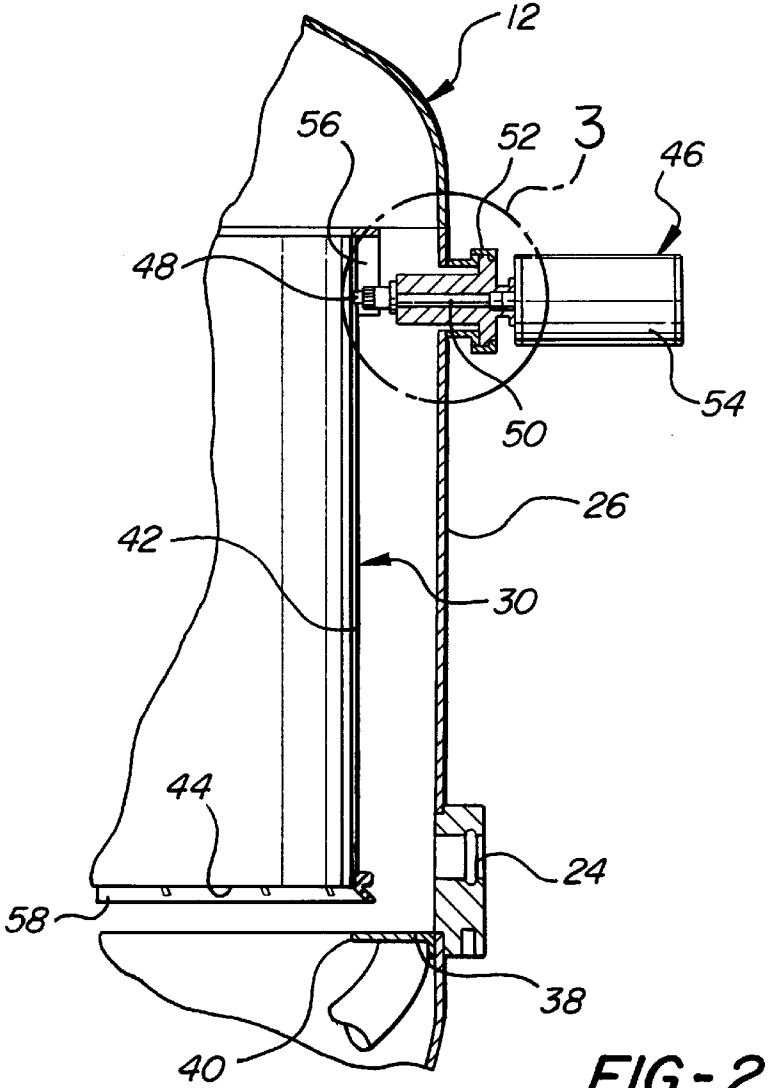
FIG. 2 is an enlarged fragmentary view of a portion of the tank of the preferred embodiment.
Figure 4:
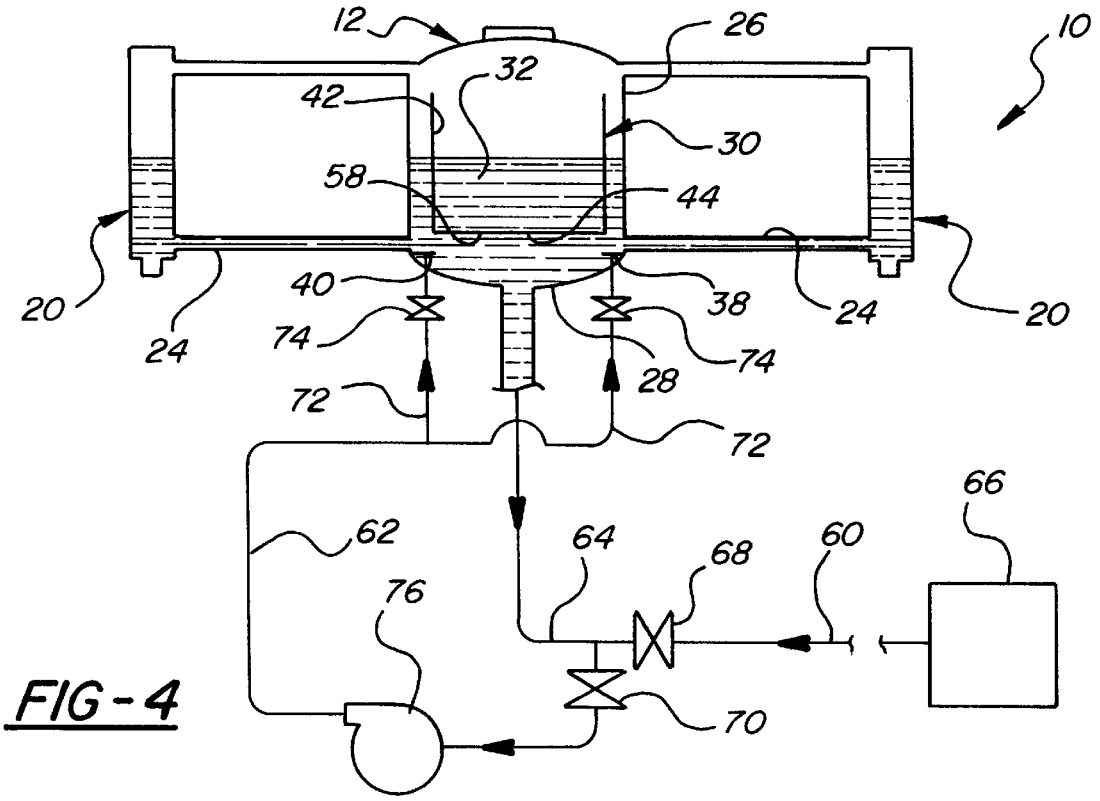
FIG. 4 is a schematic view showing the machine in the normal operating position.
Figure 5:
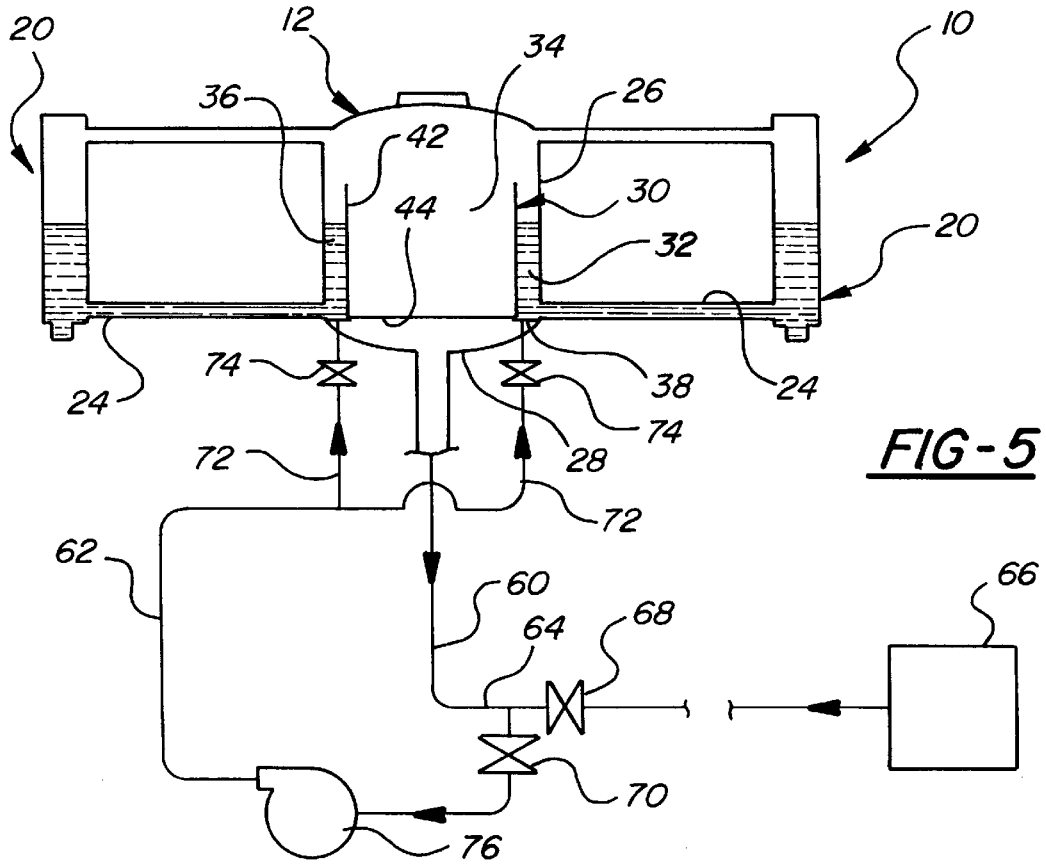
FIG. 5 is a schematic view showing the machine in the end of a filling run operating position.

The machine 10 characterized by the supply tank 12 including a tank divider, generally indicated at 30, movable between an open position, as illustrated in FIGS. 2 and 4, allowing beverage 32 to level completely across the tank 12 and a closed position, as illustrated in FIGS. 1 and 5, for dividing the tank 12 into an isolated volume 34 and a useable volume 36, as shown in FIG. 5, for removing beverage 32 from the isolated volume 34 and allowing beverage 32 to level only in the useable volume 36. More specifically, the tank divider 30 includes a ledge 38 disposed vertically above the bottom 28 and extending inwardly a predetermined distance from the vertical wall 26 to define an open space 40 and an endless wall 42 having an inside facing the isolated volume 34 and an outside facing the useable volume 36 and a lower periphery 44 defining an open bottom. The vertical wall 26 of the tank 12 is circular and the bottom 28 is bowl shaped. The endless wall is defined by a cylinder and the ledge 38 is annular in the fashion of a washer.

In addition, an actuator, generally indicated at 46, is included for moving the endless wall vertically between the open and closed positions with the lower periphery 44 of the endless wall in sealed engagement with the ledge 38 to define the isolated volume 34 in the open space 40 above the bottom 28 of the tank 12 and the useable volume 36 on the outside thereof when in the closed position and to allow beverage 32 to level completely across the tank 12 on both sides of the endless wall when the endless wall is in the open position with the lower periphery 44 thereof spaced vertically above the ledge 38, as illustrated in FIG. 4. The actuator 46 comprises a cam 48 mounted on the tank 12 via a shaft 50 rotatably supported in a housing 52 which is mounted on the tank 12. A cam follower 56 is mounted on the endless wall 42 and is in engagement with the cam 48. A drive means or motor 54 is mounted on the tank 12 via the housing for moving the cam 48 to raise and lower the endless wall 42 between the open and closed positions. A flexible seal 58 is disposed about the lower periphery 44 of the endless wall 42 to perfect a liquid seal with the ledge 38 for preventing beverage 32 flow between the isolated volume 34 and the useable volume 36 when the endless wall 42 is in the closed position.

The machine 10 includes plumbing connected to the tank 12 for filling the tank 12 and for removing beverage 32 from the isolated volume 34. As sown in FIGS. 4 and 5, the plumbing includes a main supply line 60 for flow of beverage 32 with, i.e., to and from, the bottom 28 of the tank 12 below the ledge 38 and a secondary supply line 62 for beverage 32 flow above the ledge 38 and outside of the endless wall 42. The plumbing further includes valving means for directing beverage 32 flow to fill the tank 12 through the main supply line 60 when the endless wall 42 is in the open position illustrated in FIG. 4 and for directing beverage 32 flow from the isolated volume 34 through the main supply line 60 and through the secondary supply line 62 to the useable volume 36 when the endless wall 42 is in the closed position illustrated in FIG. 5. The secondary supply line 62 is in communication with the main supply line 60 at a junction 64 with the main supply line 60 leading upstream from the junction 64 to a beverage supply, e.g., beverage processor 66 and leading downstream from the junction 64 to the tank 12. The plumbing further includes a main valve 68 upstream of the junction 64 for closing beverage 32 flow through the main supply line 60 from upstream thereof and a secondary valve 70 in the secondary supply line 62 for allowing beverage 32 flow from the tank 12 through the main supply line 60 downstream of the junction 64 and through the secondary supply line 62 to the useable volume 36. Actually, the secondary supply line 62 splits into at least two branch lines 72 each of which enters the bottom 28 of the tank 12 and feed through the ledge 38 into the useable volume 36 above the ledge 38. Cutoff valves 74 are disposed in the branch lines 72 to cutoff the return flow from the useable volume 36 when the endless wall 42 is in the open position.

The plumbing also includes a pump 76 for pumping beverage 32 from the main supply line 60 to the secondary supply line 62 when the endless wall 42 is in the closed position.

As alluded to above, the filling assembly 20 for filling a beverage container 22 extends annularly about the tank 12 and in spaced relationship thereto and the beverage feed lines 24 extend radially from the useable volume 36 of the tank 12 to the filling assembly 20 for supplying beverage 32 thereto. The filling assembly 20 includes a conveyor 78 for gripping the neck of bottles for moving bottle containers 22 in a circle about the tank 12 for filling the bottles 22 with beverage 32.

The invention also includes a method of conserving beverage 32 at the end of a run of filling beverage containers 22 from a supply tank 12 having a vertical wall 26 and a bottom 28. The method to which the improvement is made comprises the steps of filling the tank 12 with beverage 32 to level beverage 32 completely across the tank 12 as confined by the vertical wall 26 thereof and filling containers 22 with beverage 32 flowing horizontally from the vertical wall 26 of the tank 12. The method is characterized by dividing the tank 12 into a useable volume 36 adjacent the vertical wall 26 and an isolated volume 34 over the bottom 28 of the tank 12 and removing beverage 32 from the isolated volume 34 and into the useable volume 36 allowing beverage 32 to level only in the useable volume 36 for filling the containers 22. The method is further defined as supplying beverage 32 through the bottom 28 of the tank 12 to fill the tank 12 during a production run and dividing the tank 12 at the end of the production run while closing the supply of beverage 32 through the bottom 28 of the tank 12 to flow beverage 32 from the isolated volume 34 to the useable volume 36. The method includes pumping 76 beverage 32 from the isolated volume 34 to the useable volume 36 after closing the supply of beverage 32.

The dividing of the tank 12 is further defined as disposing a ledge 38 vertically above the bottom 28 of the tank 12 and extending inwardly a predetermined distance from the vertical wall 26 of the tank 12. The method also includes disposing an endless wall 42 in the tank 12 with an inside facing the isolated volume 34 and an outside facing the useable volume 36 and a lower periphery 44 defining an open bottom and moving the endless wall 42 vertically to a closed position with the lower periphery 44 of the endless wall 42 in sealed engagement with the ledge 38 to define the isolated volume 34 in the open space 40 above the bottom 28 of the tank 12 and the useable volume 36 on the outside of the endless wall 42. Initially, however, the endless wall 42 is raised to an open position with the lower periphery 44 thereof spaced vertically above the ledge 38 prior to filling the tank 12 with beverage 32 to allow beverage 32 to level completely across the tank 12 on both sides of the endless wall 42.

The method also includes the step of pumping 76 beverage 32 from the isolated volume 34 to the useable volume 36 after the endless wall 42 is moved vertically to the closed position with the lower periphery 44 of the endless wall 42 in sealed engagement with the ledge 38.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A beverage filling machine (10) comprising:

at least one filling assembly (20) having at least one horizontally extending feed line (24) for filling a beverage container (22);

a supply tank (12) for supplying beverage (32) to said filling assembly (20);

said machine (10) characterized by said supply tank (12) including a tank divider (30) movable between an open position allowing beverage (32) to level completely across said tank (12) and a closed position for dividing said tank (12) into an isolated volume (34) and a useable volume (36) for removing beverage (32) from said isolated volume (34) and allowing beverage (32) to level only in said useable volume (36).

2. A machine as set forth in claim 1 including plumbing connected to said tank (12) for filling said tank (12) and for removing beverage (32) from said isolated volume (34).

3. A machine as set forth in claim 2 wherein said tank (12) includes a peripheral vertical wall (26) and a bottom (28); and wherein said tank divider (30) includes a ledge (38) disposed vertically above said bottom (28) and extending inwardly a predetermined distance from said vertical wall (26) to define an open space (40), and an endless wall (42) having an inside facing said isolated volume (34) and an outside facing said useable volume (36) and a lower periphery (44) defining an open bottom; and including an actuator (46) for moving said endless wall (42) vertically between said open and closed positions with said lower periphery (44) of said endless wall (42) in sealed engagement with said ledge (38) to define said isolated volume (34) in said open space (40) above said bottom (28) of said tank (12) and said useable volume (36) on the outside thereof when in said closed position and to allow beverage (32) to level completely across said tank (12) on both sides of said endless wall (42) when said endless wall (42) is in said open position with said lower periphery (44) thereof spaced vertically above said ledge (38).

4. A machine as set forth in claim 3 wherein said plumbing includes a main supply line (60) for beverage flow with said bottom (28) of said tank (12) below said ledge (38) and a secondary supply line (62) for beverage flow above said ledge (38) and outside of said endless wall (42).

5. A machine as set forth in claim 4 wherein said plumbing further includes valving means for directing beverage flow to fill said tank (12) through said main supply line (60) when said endless wall (42) is in said open position and for directing beverage flow from said isolated volume (34) through said main supply line (60) and through said secondary supply line (62) to said useable volume (36) when said endless wall (42) is in said closed position.

6. A machine as set forth in claim 5 wherein said plumbing includes a pump (76) for pumping beverage from said main supply line (60) to said secondary supply line (62) when said endless wall (42) is in said closed position.

7. A machine as set forth in claim 4 wherein said secondary supply line (62) is in communication with said main supply line (60) at a junction (64) with said main supply line (60) leading upstream from said junction (64) to a beverage supply and leading downstream from said junction (64) to said tank (12), and wherein said plumbing further includes a main valve (96) upstream of said junction (64) for closing beverage flow through said main supply line (60) from upstream thereof and a secondary valve (70) in said secondary supply line (62) for allowing beverage flow from said tank (12) through said main supply line (60) downstream of said junction (64) and through said secondary supply line (62) to said useable volume (36).

8. A machine as set forth in claim 7 wherein said plumbing includes a pump (76) disposed in said secondary supply line (62) for pumping beverage from said main supply line (60) to said secondary supply line (62).

9. A machine as set forth in claim 4 including a flexible seal (58) disposed about said lower periphery (44) of said endless wall (42) for preventing beverage flow between said isolated volume (34) and said useable volume (36) when said endless wall (42) is in said closed position.

10. A machine as set forth in claim 4 wherein said actuator (46) comprises a cam (48) mounted on said tank (12) and a cam follower (56) mounted on said endless wall (42) and in engagement with said cam (48), and drive means mounted on said tank (12) for moving said cam (48) to raise and lower said endless wall (42).

11. A machine as set forth in claim 4 wherein said vertical wall (26) of said tank (12) is circular and said bottom (28) is bowl shaped, and wherein said endless wall (42) is defined by a cylinder and said ledge (38) is annular.

12. A machine as set forth in claim 4 wherein said filling assembly (20) for filling a beverage container (22) extends annularly about said tank (12) and in spaced relationship thereto, and including beverage feed lines (24) extending radially from said useable volume (36) of said tank (12) to said filling assembly (20) for supplying beverage (32) thereto.

13. A machine as set forth in claim 12 wherein said filling assembly (20) includes a conveyor (78) for moving containers (22) in a circle about said tank (12) for filling the containers (22) with beverage (32).

14. A method of conserving beverage (32) at the end of a run of filling beverage containers (22) from a supply tank (12) having a vertical wall (26) and a bottom (28), said method comprising the steps of:

filling the tank (12) with beverage (32) to level beverage (32) completely across the tank (12) as confined by the vertical wall (26) thereof, filling containers (22) with beverage (32) flowing horizontally from the vertical wall (26) of the tank (12);

said method characterized by dividing the tank (12) into a useable volume (36) adjacent the vertical wall (26) and an isolated volume (34) over the bottom (28) of the tank (12) and removing beverage (32) from the isolated volume (34) and into the useable volume (36) allowing beverage (32) to level only in said useable volume (36) for filling the containers (22).

15. A method as set forth in claim 14 further defined as supplying beverage (32) through the bottom (28) of the tank (12) to fill the tank (12) during a production run and dividing the tank (12) at the end of the production run while closing the supply of beverage (32) through the bottom (28) of the tank (12) to flow beverage (32) from the isolated volume (34) to the useable volume (36).

16. A method as set forth in claim 15 further defined as pumping (76) beverage (32) from the isolated volume (34) to the useable volume (36) after closing the supply of beverage (32).

17. A method as set forth in claim 15 wherein the dividing of the tank (12) is further defined as disposing a ledge (38) vertically above the bottom (28) of the tank (12) and extending inwardly a predetermined distance from the vertical wall (26) of the tank (12), disposing an endless wall (42) in the tank (12) with an inside facing the isolated volume (34) and an outside facing the useable volume (36) and a lower periphery (44) defining an open bottom, and moving the endless wall (42) vertically to a closed position with the lower periphery (44) of the endless wall (42) in sealed engagement with the ledge (38) to define the isolated volume (34) in the open space (40) above the bottom (28) of the tank (12) and the useable volume (36) on the outside of the endless wall (42).

18. A method as set forth in claim 17 further defined as raising the endless wall (42) to an open position with the lower periphery (44) thereof spaced vertically above the ledge (38) prior to filling the tank (12) with beverage (32) to allow beverage (32) to level completely across the tank (12) on both sides of the endless wall (42).

19. A method as set forth in claim 18 further defined as pumping (76) beverage (32) from the isolated volume (34) to the useable volume (36) after the endless wall (42) is moved vertically to the closed position with the lower periphery (44) of the endless wall (42) in sealed engagement with the ledge (38).

* * * * *